US007066415B2

(12) United States Patent
Strutz

(10) Patent No.: US 7,066,415 B2
(45) Date of Patent: Jun. 27, 2006

(54) TOUCH PAD CONTROL INFORMATION SYSTEM FOR A FOOD WASTE DISPOSER

(75) Inventor: William F Strutz, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 17 days.

(21) Appl. No.: 10/458,099

(22) Filed: Jun. 10, 2003

(65) Prior Publication Data

US 2004/0251339 A1 Dec. 16, 2004

(51) Int. Cl.
*B02C 25/00* (2006.01)

(52) U.S. Cl. ..... 241/36; 241/101.3; 241/46.013

(58) Field of Classification Search ..... 241/46.013, 241/46.014, 46.015, 30, 36, 101.3; 4/DIG. 4
See application file for complete search history.

(56) References Cited

U.S. PATENT DOCUMENTS

| | | | | |
|---|---|---|---|---|
| 2,678,775 | A * | 5/1954 | Simmons | 241/32.5 |
| 3,420,455 | A * | 1/1969 | Chorney | 241/36 |
| 3,545,684 | A * | 12/1970 | Hilmanowski et al. | 241/33 |
| 5,971,303 | A | 10/1999 | Pugh-Gottlieb | |
| 6,198,079 | B1 | 3/2001 | Essig | |
| 6,364,226 | B1 * | 4/2002 | Kubicko | 241/36 |
| 6,481,652 | B1 | 11/2002 | Strutz | 241/46.013 |
| 6,610,942 | B1 | 8/2003 | Anderson et al. | |
| 6,636,135 | B1 * | 10/2003 | Vetter | 335/205 |
| 6,854,673 | B1 | 2/2005 | Strutz et al. | |
| 6,904,926 | B1 * | 6/2005 | Aylward et al. | 137/119.01 |
| 2004/0178288 | A1 | 9/2004 | Berger et al. | |
| 2004/0178289 | A1 | 9/2004 | Jara-Almonte et al. | |

FOREIGN PATENT DOCUMENTS

| | | | |
|---|---|---|---|
| DE | 3233516 | * | 3/1984 |
| GB | 2234191 | A | 1/1991 |
| JP | 11028381 | | 2/1999 |

OTHER PUBLICATIONS

Invention Disclosure document signed by inventor William F. Strutz on Oct. 31, 1989.
Technical Disclosure of prior art food waste disposer system manufactured by Toto (date unknown).
International Search Report, PCT/US2004/017807, European Patent Office, Nov. 5, 2004.
Written Opinion of the International Searching Authority, PCT/US2004/017807, European Patent Office, Nov. 5, 2004.

* cited by examiner

*Primary Examiner*—Mark Rosenbaum
(74) *Attorney, Agent, or Firm*—Locke Liddell & Sapp LLP

(57) ABSTRACT

A touch pad control information system for a food waste disposer is disclosed. The touch pad is mountable to a wall or countertop near the food waste disposer. The touch pad preferably includes switches which allow the user to select from a plurality of disposer functions, and light emitting diodes (LEDs) or other graphic display to indicate one of a plurality of statuses for the disposer. The touch pad is coupled to the disposer by a wire bus or by wireless means.

23 Claims, 3 Drawing Sheets

TOUCH PAD CONTROL INFORMATION SYSTEM FOR A FOOD WASTE DISPOSER

FIELD OF THE INVENTION

The present invention relates generally to a food waste disposer and more particularly to a touch pad control information system for a food waste disposer.

BACKGROUND

Common food waste disposers are typically single speed devices usually operated by a switch that which is often mounted to a wall in near vicinity to the disposer (e.g., beside the sink to which the disposer is affixed). This may not be most advantageous, because a single grinding speed is not always optimal for grinding foods of different hardnesses or constituencies, and otherwise limits the functionality of the disposer.

For example, U.S. Pat. No. 6,481,652, which is incorporated herein by reference in its entirety, discloses a food waste disposer which can operate at various speeds to either optimize grinding or perform other beneficial functions. For, example, the '652 patent recognizes that it can be beneficial to grind softer or stringy foods at higher speeds, while grinding harder foods at slower speeds. Accordingly, a grinding algorithm (or mode) is disclosed in the '652 patent in which the disposer grinds at a high speed for a set time, followed by a medium speed for a set time, followed by a low speed. This optimized grinding algorithm is beneficial in that it allows food of all hardnesses to be optimally ground during at least one portion of the grind cycle.

Other useful algorithms are disclosed in the '652 patent. For example, a soft start mode is disclosed, during which the speed of the disposer is gradually increased after it is turned on by the user so that the disposer does not become overwhelmed and clogged by an initial slug of food waste. An idle mode detects whether food waste is present in the disposer, and drops the disposer's speed during periods when the food waste disposer is empty (such as when the user is walking back and forth between the dinner table) to decrease the noise of the disposer. A rinse mode increases the speed of the disposer near the end of a grinding cycle to more effectively splash water within the grinding chamber to wash it clean, thereby reducing foul odors. An anti-jamming mode allows for the detection of objects that have might have jammed the disposer, such as eating implements (e.g., spoons, forms, or knives) or bone fragments, and automatically takes corrective action, for example, by reversing the direction of rotation of the motor that performs the grinding in an attempt to dislodge the jam. (Further details concerning some of these modes can be found in U.S. patent application Ser. No. 10/262,776, filed Oct. 2, 2002, which is incorporated herein by reference). All or some of these algorithms disclosed in the '652 patent can be concatenated together (e.g., soft start, then optimizing grinding, then rinse), with perhaps the idle and anti-jamming modes running in the background should idleness or jamming become an issue during a grinding operation.

However, these disclosed algorithms are not controllable, or modifiable, by the user, and instead are automatically implemented by a motor controller when the disposer is turned on. Such a hands-off approach may not always be desirable. For example, if only hard foods such as bone fragments are to be ground, the high and medium speed portions of the optimized grinding algorithm may not be useful, and might therefore preferably be dispensed with.

Likewise, for stringy foods, like celery, it might only be preferable to operate the disposer at a high speed. If the disposer smells bad, the user may simply wish to run the rinse mode without having the disposer perform the optimized grinding mode at all. In short, the user has little control over how the disposer is to be operated, and instead must be content that the disposer will perhaps perform all of these potential algorithms whether they are needed or not.

In addition to lack of user control, disposers such as those disclosed in the '652 patent provide the user with no indication of what the disposer is doing at any given time. This lack of feedback impedes the benefits that improved functionality provides. For example, the user may wish to know when the disposer is running the idle mode algorithm, which might indicate to the user that the disposer is empty and can now be turned off, or that the rinse mode should be activated. In another example, it is useful for the user to know if the disposer is running the anti-jamming algorithm. Although this algorithm preferably performs its own corrective action measures, the user may still need to intervene, for example, by removing an eating implement from the grinding chamber so that the disposer will not become jammed again. Stated more generally, it is useful for the user to have some feedback concerning what is occurring with the disposer to enable the user to take appropriate actions.

In short, while food waste disposers such as those disclosed in the '652 patent have improved functionality over more commonplace single speed disposers, they provide no mechanism to allow users to take full control of that functionality, and further provide no indication concerning the functions being performed or the status of the disposer, which hampers the usefulness of this increased functionality.

SUMMARY OF THE DISCLOSURE

Disclosed herein is a touch pad control information system for a food waste disposer. The touch pad is mountable to a wall or countertop near the food waste disposer. The touch pad preferably includes switches which allow the user to select from a plurality of disposer functions, and light emitting diodes (LEDs) or other graphic display to indicate one of a plurality of statuses for the disposer. The touch pad is coupled to the disposer by a wire bus or by wireless means.

BRIEF DESCRIPTION OF THE DRAWINGS

The foregoing summary, preferred embodiments, and other aspects of the inventive concepts will be best understood with reference to a detailed description of specific embodiments, which follows, when read in conjunction with the accompanying drawings, in which.

Figure 1:
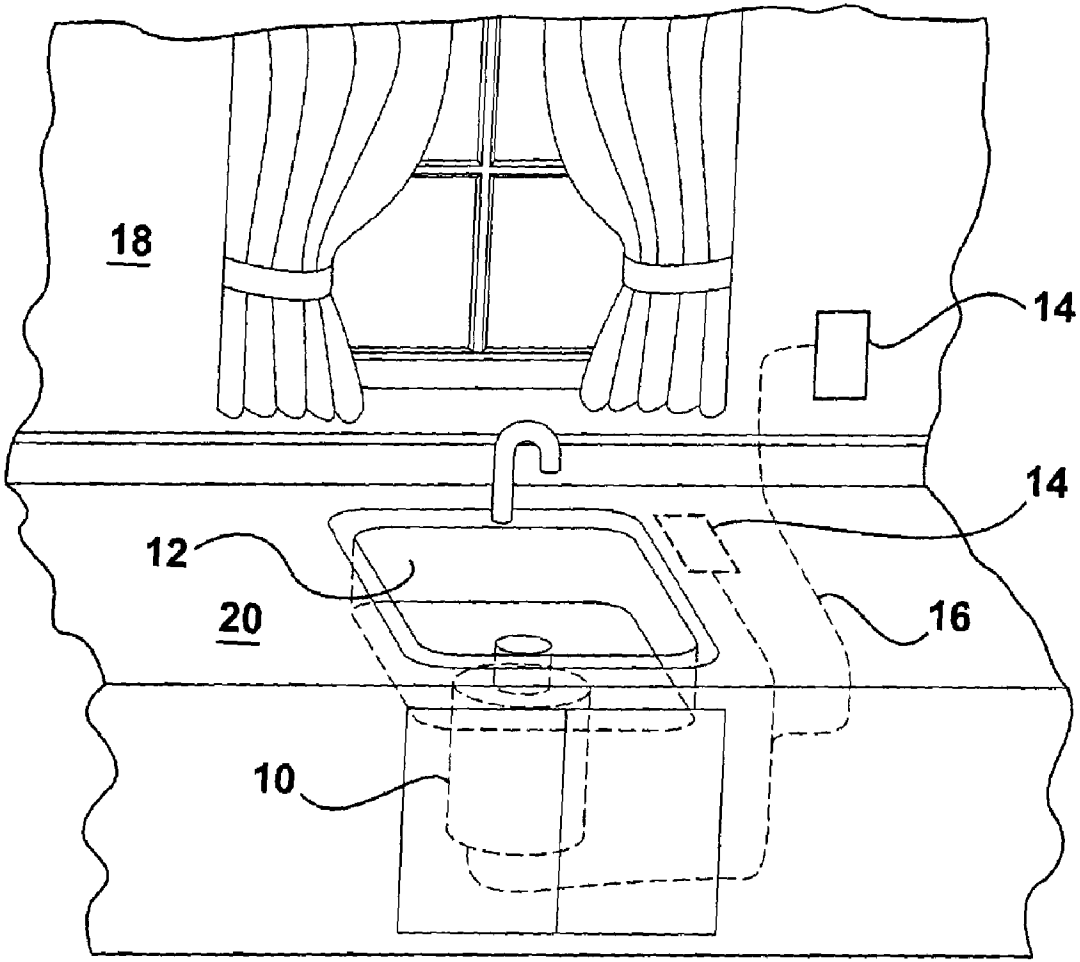
FIG. 1 illustrates a food waste disposer mounted under a sink and coupled to a touch pad by a bus.

While the disclosed touch pad control information system for a food waste disposer is susceptible to various modifications and alternative forms, specific embodiments thereof have been shown by way of example in the drawings and are herein described in detail. The figures and written description are not intended to limit the scope of the disclosed reduction mechanism in any manner. Rather, the figures and written description are provided to illustrate the disclosed system to a person of ordinary skill in the art, as required by 35 U.S.C. § 112.

DETAILED DESCRIPTION

In the interest of clarity, not all features of actual implementations of a touch pad control information system for a food waste disposer are described in the disclosure that follows. It should be appreciated that in the development of any such actual implementation, as in any such project, numerous engineering and design decisions must be made to achieve the developers' specific goals, e.g., compliance with mechanical and business related constraints, which will vary from one implementation to another. While attention must necessarily be paid to proper engineering and design practices for the environment in question, it should be appreciated that the development of a touch pad control information system for a food waste disposer would nevertheless be a routine undertaking for those of skill in the art given the details provided by this disclosure.

FIG. 1 shows a disposer 10 mounted under a sink 12, and in electrical communication with a touch pad control information system 14 (hereinafter touch pad 14). The touch pad 14 preferably communicates with the disposer 10 through the use of a conduit or bus 16, which contains the wires that span between the disposer and the touch pad in accordance with a circuit schematic to be explained later. However, and as explained later, the touch pad 14 and disposer can also communicate by a wireless link. The touch pad is illustrated as mounted to a wall 18, but could also be attached to an adjacent countertop 20 as shown in dotted lines. As one skilled in the art will recognize, when routing the bus 16, normal wiring considerations should be made to bypass the cabinetry and/or the wall.

Figure 2:
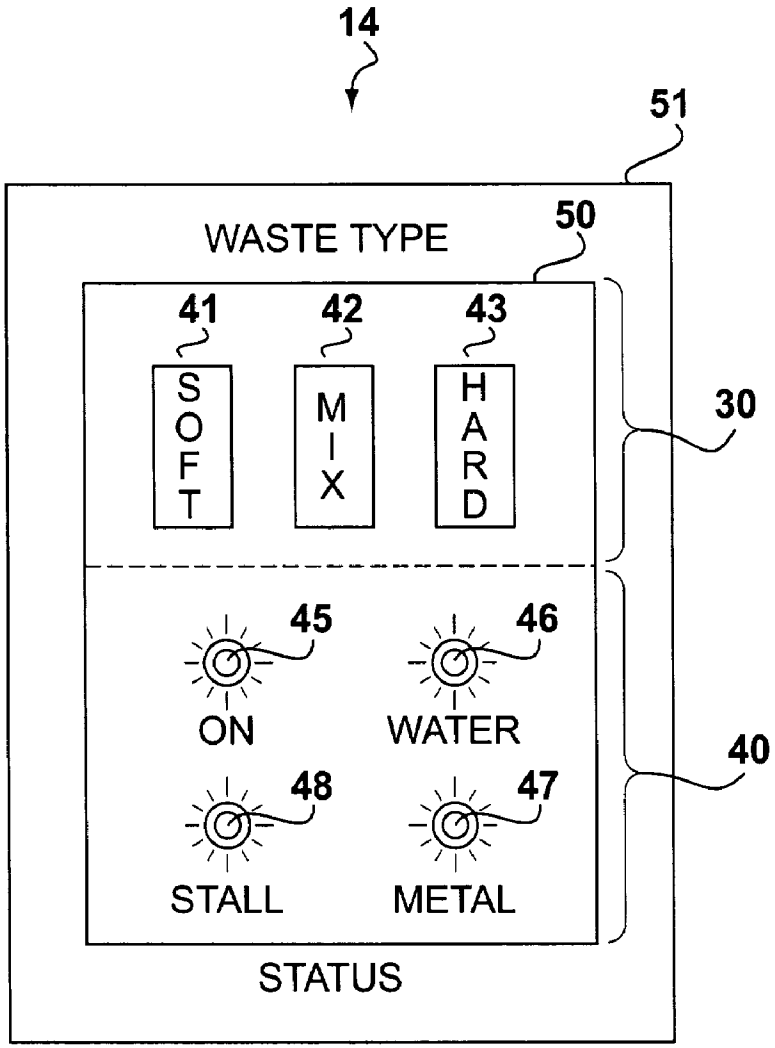
FIG. 2 illustrates the touch pad in further detail.

FIG. 2 shows the touch pad 14 in further detail in one embodiment. The touch pad 14 includes a touch-sensitive switch area 30 and a status indicator area 40. The switch area 30 includes various switches for controlling the operation of the disposer 10. For example, in this embodiment, switch area includes three switches 41, 42, and 43 for operating the disposer at respectively lower speed. Because the user may not particularly care what speed is chosen, but is more concerned with adequately grinding food waste of a particular constituency, these switches 41–43 are conveniently labeled as "soft," "hard," and "mix." Of course, these switches could be alternatively labeled with motor speed (e.g., fast or slow, or with the actual motor rpm speed), but such technically-accurate information may not be as helpful to a lay user of the disposer 10.

The status indicator area 40 provides the user information concerning the status of the disposer 10. For example, and as shown, the status indicator area 40 includes light, specifically light emitting diodes (LEDs) 45–48, which indicate that the disposer has been turned on (LED 45), that water is running within the unit (LED 46), that the unit has stalled because of a jam (LED 48), and that metal (e.g., an eating implement) has been detected in the disposer (LED 47). A circuit controller 100 controls the operation of the LEDs 45–48, and receives input from the switches 41–43, as will be explained in conjunction with the circuit diagram of FIG. 3.

In a preferred embodiment, the touch pad 14 is comprised of two parts: an electrical box 50 and a electrical box cover 51. Both of these components are preferably of a standard size used in household electrical outlets, with the electrical box 50 measuring 1.75×2.75 inches and the electrical box cover 51 measuring 2.75×4.5 inches. Of course, other sizes for these components could be used.

The switches 41–43 could comprise many different type of actuating switches, including regular light switches, or spring action buttons, but are preferably touch sensitive bubble switches which are common in the appliance industry.

Likewise, other types of indicators (conventional filament lights, gauges, etc.) could be used in lieu of LEDs 45–48. Or, the status indicator area 40 could comprise a textual readout, for example, a liquid crystal display or dot matrix display which would spell out the status ("running," "idle," "jammed," "high speed," etc.). In this embodiment, the display could include several lines or areas to allow multiple statuses to be displayed if necessary (e.g., "jammed" and "metal in unit"). Alternatively, other non-visual indicators could be used, such as audible alarms which broadcast different noises or tones through a speaker (not shown) in accordance with the indicator being activated. In a more complicated approach, the speaker could broadcast the status by playing a recorded voice, which would "speak" the relevant status.

In a preferred embodiment, the electrical box 50 contains a single uniform layer of a plastic laminate over both the switches 41–43 and the LEDs 45–48, as is common in the appliance industry. This construction allows the function for the switches and a description of the status indicators to be written onto the laminate layer, while also protecting the switches and indicators from damage and moisture. As the laminate layer is basically flat, it is easily cleaned by with a damp cloth.

Figure 3:
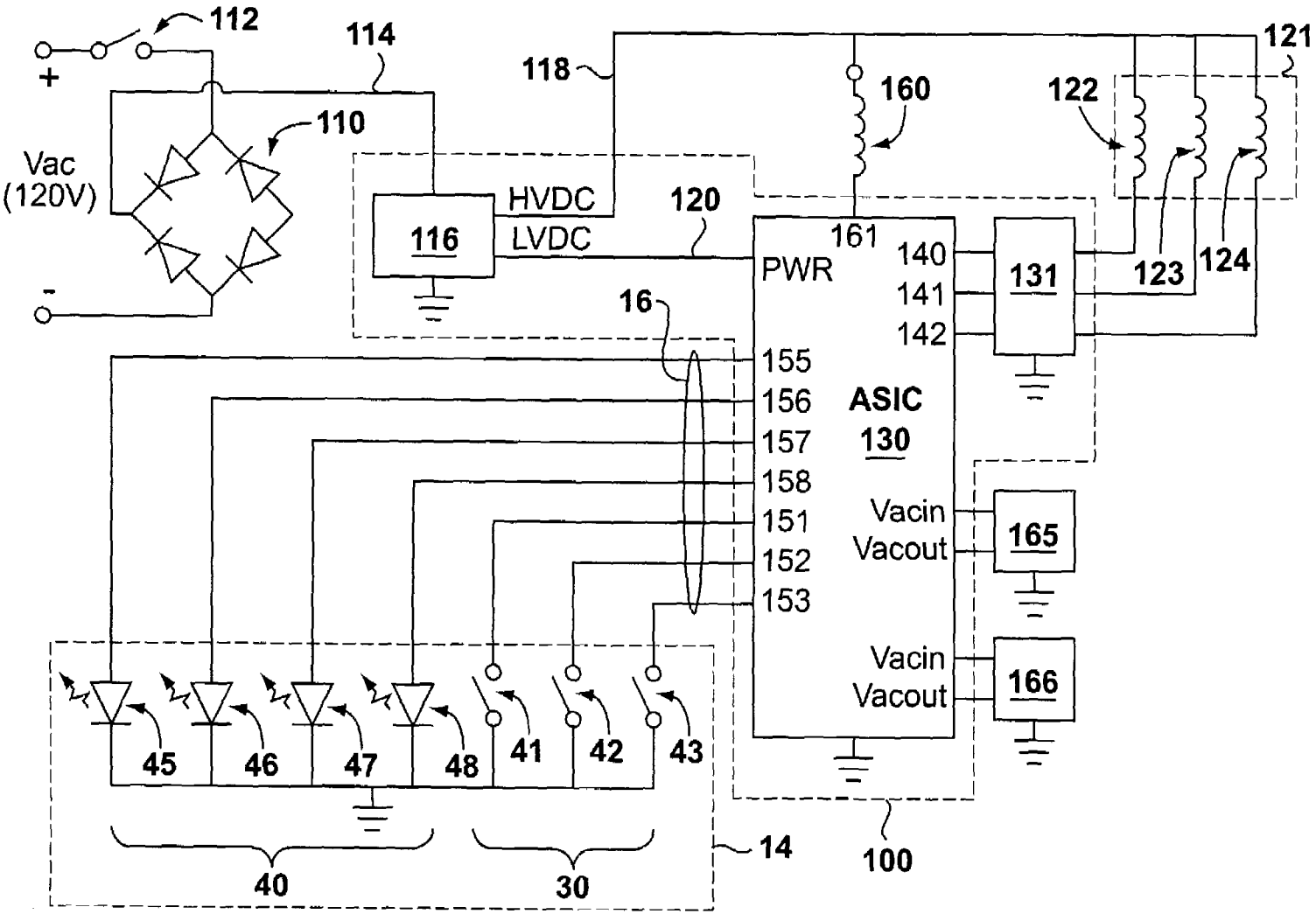
FIG. 3 illustrates a circuit schematic for controlling and monitoring the operation of the food waste disposer using the touch pad.

FIG. 3 shows a circuit controller 100 useable with the touch pad 14 and disposer 10. The components for the circuit controller 100 are preferably integrated on a single circuit board to be mounted in the body of the disposer, although other components may be separately placed elsewhere in the body of the disposer as dictated by their functions and by convenience. Alternatively, the circuit controller 100, and possibly some of the other components in FIG. 3, could be mounted outside of the food waste disposer. For example, they could be mounted on the outside of the disposer and appropriately housed, or could be integrated within or proximate to the electrical box 50 of the touch pad 14.

AC voltage (e.g., 120 AC) is input to the circuit controller 100 via a DC voltage generation circuit 110 which, for example, can regulate the voltage on line 114 to a voltage high enough to run both the disposer's motor 121 and an ASIC or SoC (System on a Chip) 130, as will be explained in further detail later. If the disposer 10 is a "batch feed" disposer, whereby the disposer can be run only after food waste has been placed in the disposer and a cover is positioned in the drain opening, the DC voltage generation circuit 110 may be interruptible by a lock cover switch 112 which interfaces with the cover, although this switch is not generally used for "continuous feed" disposers common in the United States market. (An example of a batch feed disposer having a cover for activating such a switch is disclosed in U.S. patent application Ser. Nos. 10/389,142 and 10/389,160, both filed Mar. 14, 2003, which are incorporated herein by reference).

The regulated voltage on line 114 is fed to a dual voltage regulator 116, which regulates the voltage on line 118 to a voltage high enough to energize the windings 122–124 of the motor 121, and which regulates the voltage on line 120 to a voltage high enough to power the ASIC 130. Such dual voltage regulators are well known and are not further described. Although shown as forming a portion of the controller 100, one skilled in the art will recognize that the voltage regulator 116 could constitute a separate component. Motor 121 may be any suitable variable speed motor, and preferably constitutes either a switched reluctance (SWR)

motor or a brushless permanent magnet (BLPM) motor. Depending on the type of motor to be used, more or less motor windings could be used, as one skilled in the art of motorized appliances will understand.

Application Specific Integrated Circuit (ASIC) 130 is specially designed to provide the basic functionality to controller 100, and therefore to the motor 121 and to touch pad 14. In a preferred embodiment, ASIC 130 constitutes a mixed signal chip capable of handling both digital and analog signals. The various functions performed by ASIC 130, and its inputs and outputs are described herein. Because the technology for designing an ASIC chip to perform these described functions is advanced and well known in the art, and well within the skill of those skilled in the mixed signal processing arts, further details concerning the construction of ASIC 130 are not described.

The ASIC chip 130 contains various inputs and outputs. Switches 41–43, controlling motor speed, are input to the ASIC 130 at inputs 151–153 along bus 16. LEDs 45–48 are likewise coupled to outputs 155–158 of ASIC 130 along bus 16. The ASIC chip 130 at outputs 140–142 controls the timing of activation of the windings 122–124 in conjunction with switching circuit 131, which could perform varying functions depending on the exact type of motor 121 used as one skilled in the art of motorized appliances will understand. The switching circuit 131 may be integrated with the ASIC 130 or can remain separate therefrom. In response to closure of the switches 41–43 by the user, the motor speed is accordingly adjusted, which closure of the switches informing the ASIC chip 130 to affect the timing and/or current at outputs 140–142 for faster or slower motor operation. If the ASIC 130 detects that the drive current has become too high at outputs 140–142, a signal is sent to output 157 to light LED 47 on touch pad 14, i.e., the "unit stalled" LED. (Further details concerning detecting a jam condition are disclosed in U.S. patent application Ser. No. 10/262,776, filed Oct. 2, 2002, which is incorporated herein by reference).

Other indicator LEDs in status indicator area 40 of the touch pad 14 function similarly. For example, if the disposer 10 has been turned on by the user, i.e., by pressing any of switches 41–43, the motor 121 is started and a signal is sent to output 155 by ASIC 130 to enable illumination of LED 45 to inform the user of this fact.

Similarly, turning on the disposer 10, in some applications, may start the flow of water through a water input conduit (not shown) into the grinding chamber of the disposer 10 through a controllable valve, as is well known. Such a valve is controllable by a water solenoid 160, which is coupled to output 161 of the ACIS 130, and which is engaged at start up to close the solenoid and open the valve to run water into the grinding chamber. In addition, if the water input conduit contains a flow sensor 165, the flow of water can be verified by the ASIC 130, which causes illumination of LED 46 on output 156. Water flow can be measured in a variety of different ways, including the use of mechanical or electrical flow devices providing digital or analog outputs as is known in the art.

The "water on" indicator LED 46 can also be used in disposers which do not have solenoid-controlled water input conduits. For example, traditional disposers 10 generally require the user to run water into the disposer during operation. Various flow sensors 165 could be used to detect the presence of water flowing through the disposer, for example, by placing a flow sensor in faucet inlet line or the discharge outlet from the grinding chamber. Accordingly, should LED 46 not be lit, the user is reminder to turn the water on to allow food waste to be properly ground, which protects the disposer from overheating, clogging, and damage.

Because some jams may be caused by metal objects such as eating implements, a metal sensor 166 can be used to detect this event. Such a device measures the inductive coupling between the grinding plate (via the rotor) and the shedder ring affixed to grinding chamber wall, which is grounded. By assessing the phase shift between an AC input interrogation signal sent by the ASIC 130, and a detected AC output, it can be inferred that a metal device has intervened in the magnetic field between the grinding plate and the shredder ring. Accordingly, if a sufficiently high phase shift is detected by the ASIC 130, the ASIC 130 can cause illumination of LED 47 on output 157, which would inform the user that the metal object needs to be retrieved from the grinding chamber of the disposer. If the metal object has also caused a jam in the disposer, LED 48 may also be illuminated as explained above. The sensor may also employ technologies other than inductive coupling, known to those skilled in the art.

In short, touch pad 14 provides the user with greater flexibility in operating the disposer, and provides a feedback mechanism to inform the user of the status of the disposer. Of course, other modifications are possible, both as to the degree of user control and disposer feedback.

For example, if a temperature sensor is used to monitor motor temperature, an LED could be included on the status indicator area of touch pad 14 to inform the user if the unit has overheated.

Moreover, many disposers are designed with current overload switches, which are typically located on the end (bottom) plate of the disposer 10, and which the user may need to reset before operating the disposer. (See, e.g., U.S. patent application Ser. No. 10/196,599, filed Jul. 16, 2002, which is incorporated herein by reference). Should the overload switch need to be tripped, an LED labeled "overload" could be informed to notify the user of this fact. This can be a great benefit to the user, who otherwise might not understand why his disposer is no longer functioning.

If the disposer includes a bottle for administering additives into the grinding chamber, a fluid level sensor could be included with these bottles and coupled to the ASIC 130, which could then illuminate an LED to inform the user when these bottles are low and need to be refilled or changed.

Additionally, many of the benefits of the various operational algorithms in the above-incorporated '652 patent can be implemented with greater user control. For example, a switch similar to switches 41–43 could be used to run the above-mentioned soft start algorithm (or this could be automatically performed by the ASIC 130 when the disposer is turned on). Or, if the sink smells bad, the user may simply want to run the above-mentioned rinse mode without placing food waste in the disposer, and a switch could be incorporated to run that algorithm at the user's discretion. In another example, a switch could be used to run the above-mentioned idle mode. By toggling the idle mode switch, the ASIC 130 would be informed to drop the speed of the motor when the motor's drive current drops to lower levels, which, as explained in the above referenced U.S. patent applications, would happen when food waste is not present in the disposer. In addition, all or some of these modes could be programmed into the ASIC 130 and performed automatically, perhaps subject to user override by pressing a given switch.

The switches in the touch-sensitive switch area 30 and the LEDs (or other indicators) in the status indicator area 40 do not need to be positioned in separate areas of the touch pad 14 and may even be integrated. For example, if an idle mode switch is used, the face of that switch can include an LED to inform the user that this mode has been engaged. Or a light operated by or incorporated into each of the motor speed switches can illuminate when a given switch is pressed to inform the user of his motor speed selection. Similarly, a rinse mode switch, were such a switch used, could also contain an indicator light incorporated with the switch to inform the user that this mode has been selected.

It should be understood that these various user options, and status indicators, are merely illustrative and could constitute other options or indicators not mentioned in this disclosure.

The printed circuit board for the control circuitry 100 (and other associated circuitry, if any) can be bolted to the end (bottom) plate of the disposer, or could be similarly affixed to the cylindrical sides of the disposer, or elsewhere. As is a common practice, the printed circuit board preferably connects via a linear connector to an internal bus cord, which in turn communicates with a connector mounted through the disposer. Accordingly, bus 16, which preferably constitutes a cable having suitable terminals, could be plugged into this connector to quickly and easily electrically couple the disposer 10 to the touch pad 14.

In an alternative arrangement, the disposer 10 and the touch pad can communicate by wireless means. For example, the ASIC 130 on the control circuitry can connect to a short range transmitter/antenna, similar to those used in home telephones or garage door openers, or other wireless communication protocols, such as Bluetooth. The electrical box 50 of touch pad 14 could contain a similar transmitter/antenna, which would allow wireless communication between the disposer 10 and the touch pad 14. Such an arrangement would be simpler to implement as the user would not have to electrically connect the disposer 10 and the touch pad 14, and would not have to accommodate routing of a bus 16 though his wall or cabinetry.

While it is preferred that the touch pad 14 include both a switch area 30 and a status indicator area 40, this in not strictly necessary. For some applications, only a switch area 30, allowing the user to select the function of the disposer may be necessary without the need for status information. In other applications, only the status indicator area 40 may be needed, if user control is not an issue. For example, if the disposer is not a multi-speed disposer, or otherwise does not have multiple user-engageable functions, then a mere display area to inform the user of the disposer's status can be used without switches.

When this disclosure refers to selecting from a plurality of disposer functions, it should be understood that a plurality of disposer function does not constitute merely turning the disposer on and off. In other words, switches for merely turning the disposer on and off, e.g., an on and off switch in the switch area 30, do not allow for the selection of a plurality of disposer functions. Instead, a plurality of disposer function implies operating the disposer in a plurality of different ways.

The foregoing description of preferred and other embodiments are not intended to limit or restrict the scope or applicability of the inventive concepts contained herein. It is intended that the inventive concepts contained herein include all modifications and alterations to the full extent that they come within the scope of the following claims or equivalents thereof.

What is claimed is:

1. A system, comprising:

a food waste disposer having a motor with a plurality of energizable windings;

an AC voltage input connectable to a source of AC voltage;

a controller connected to the food waste disposer and the control panel, the controller including a signal processing circuit;

a DC voltage generation circuit connected to the AC voltage input for converting received AC voltage to DC voltage;

a dual voltage regulator connected to an output of the DC voltage generation circuit to regulate the DC voltage a voltage high enough to energize the windings of the motor, and to a voltage high enough to power the signal processing circuit a switching circuit connected to outputs of the signal processing circuit to control energization of the windings; and a control panel in communication with the disposer for allowing a user of the disposer to choose from a plurality of functions that the disposer can perform, the control panel including a first status indicator connected to an output of the signal processing circuit, wherein the signal processing circuit activates the first status indicator in response to current sensed at the switching circuit exceeding a predetermined level.

2. The system of claim 1, wherein the control panel is mounted to either a countertop or wall located proximate to the food waste disposer.

3. The system of claim 2, wherein the food waste disposer is mounted underneath a sink.

4. The system of claim 1, wherein the control panel comprises a plurality of switches connected to corresponding inputs of the signal processing circuit, and wherein the user chooses from the plurality of functions by depressing one of the switches.

5. The system of claim 1, wherein the control panel is connected to the signal processing circuit.

6. The system of claim 5, wherein the food waste disposer includes a housing, the signal processing circuit being situated inside the housing and including a connector, and wherein a bus communicates with the food waste disposer by coupling the bus to the connector.

7. The system of claim 6, wherein the connector is coupled to an end plate of the disposer.

8. The system of claim 1, wherein the control panel communicates with the signal processing circuit by a wireless link.

9. The system of claim 1, wherein the controller comprises an application specific integrated circuit.

10. The system of claim 1, wherein the plurality of functions comprises a plurality of motor speeds.

11. The system of claim 1, wherein the plurality of functions are selected from the group consisting of a soft start mode, a rinse mode, an optimized grinding mode and an idle mode.

12. The system of claim 1, wherein the first status indicator comprises an audible indicator.

13. The system of claim 1, wherein the first status indicator comprises a textual display for textually displaying the status.

14. The system of claim 1, wherein the first status indicator comprises at least one light associated with the status.

15. The system of claim 1, further comprising:

a metal sensor connected to the signal processing circuit to detect the presence of a metal object in the food waste disposer; and the control panel including a second status indicator;

wherein the signal processing circuit activates the second status indicator in response to the metal sensor.

16. The system of claim 15, wherein the food waste disposer includes:

a stationary shredder ring, the shredder ring being electrically grounded;

a grinding plate connected to a shaft of the motor such that the grinding plate is rotatable relative to the shredder ring;

wherein the metal sensor measures inductive coupling between the grinding plate and the shredder ring to detect the presence of a metal object in the food waste disposer.

17. The system of claim 1, further comprising a water solenoid connected to an output of the signal processing circuit, wherein the signal processing circuit activates the water solenoid in response to starting the food waste disposer.

18. The system of claim 1, further comprising a lock cover switch coupled to the AC voltage input to connect the AC voltage input to the source of AC voltage in response to a cover being situated in a drain opening of the food waste disposer.

19. The system of claim 1, wherein the motor is a variable speed motor.

20. The system of claim 19, wherein the motor is a switched reluctance motor.

21. The system of claim 19, wherein the motor is a brushless permanent magnet motor.

22. The system of claim 19, wherein the control panel includes a speed switch, and wherein the signal processing circuit and the switching circuit control the speed of the motor in response to the speed switch.

23. The system of claim 1, further comprising a water flow sensor connected to the signal processing circuit for sensing the presence of water in the food waste disposer.

* * * * *